US010329871B2

(12) United States Patent
King et al.

(10) Patent No.: US 10,329,871 B2
(45) Date of Patent: Jun. 25, 2019

(54) DISTINTEGRABLE WET CONNECTOR COVER

(71) Applicants: James King, Kingwood, TX (US); Marc Samuelson, Houston, TX (US)

(72) Inventors: James King, Kingwood, TX (US); Marc Samuelson, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/808,215

(22) Filed: Nov. 9, 2017

(65) Prior Publication Data

US 2019/0136660 A1 May 9, 2019

(51) Int. Cl.
*E21B 29/02* (2006.01)
*E21B 33/13* (2006.01)

(52) U.S. Cl.
CPC ..... *E21B 33/13* (2013.01); *E21B 29/02* (2013.01)

(58) Field of Classification Search
CPC ..... E21B 33/13; E21B 29/02
See application file for complete search history.

(56) References Cited

U.S. PATENT DOCUMENTS 4,997,384 A * 3/1991 Godfrey ..... E21B 17/028 166/340
7,527,095 B2 * 5/2009 Bloess ..... E21B 33/134 166/228
2006/0260803 A1 * 11/2006 Meijer ..... E21B 17/023 166/244.1
2011/0056702 A1 * 3/2011 Sharma ..... E21B 17/026 166/378
2013/0032357 A1 * 2/2013 Mazyar ..... E21B 41/00 166/376
2013/0043041 A1 * 2/2013 McCoy ..... E21B 34/14 166/373
2013/0300066 A1 * 11/2013 Xu ..... E21B 33/12 277/336
2014/0060834 A1 * 3/2014 Quintero ..... E21B 33/13 166/292
2016/0009986 A1 * 1/2016 Crews ..... C09K 8/52 166/376
2017/0183937 A1 * 6/2017 Harper ..... E21B 34/14

FOREIGN PATENT DOCUMENTS

WO WO-2013089941 A1 * 6/2013 ..... E21B 31/002

* cited by examiner

*Primary Examiner* — Zakiya W Bates
*Assistant Examiner* — Crystal J Miller
(74) *Attorney, Agent, or Firm* — Cantor Colburn LLP

(57) ABSTRACT

A method of protecting a component in a wet environment includes disposing a component into a wet environment, deploying a granulated disintegrable material into the wet environment and temporarily covering a portion of the component with the granulated disintegrable material, at least partially disintegrating the granulated disintegrable material, and flushing the granulated disintegrable material away from the portion.

20 Claims, 6 Drawing Sheets

DISTINTEGRABLE WET CONNECTOR COVER

BACKGROUND

Many energy industry operations include the deployment of various devices and components that perform functions related to, e.g., hydrocarbon exploration, measurement of parameters and conditions in downhole environments, CO2 sequestration, stimulation of formations, and production of hydrocarbons.

In some instances, performance of an energy industry operation includes connecting, disconnecting, and/or reconnecting various components within a downhole environment. For example, when components are deployed separately downhole, control lines are connected by wet connectors to provide a common pathway.

SUMMARY

Disclosed is a method of protecting a component in a wet environment includes disposing a component into a wet environment, deploying a granulated disintegrable material into the wet environment and temporarily covering a portion of the component with the granulated disintegrable material, at least partially disintegrating the granulated disintegrable material, and flushing the granulated disintegrable material away from the portion.

Also disclosed is a system for protecting a component in a wet environment includes a deployment device configured to deploy a granulated disintegrable material into the wet environment and temporarily cover a portion of a component in the wet environment with the granulated disintegrable material. A triggering device is configured to at least partially disintegrate the granulated disintegrable material. A fluid control device is configured to flush the granulated disintegrable material away from the portion.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Systems and methods are described herein for performing and/or facilitating connections between components in a wet environment, such as a downhole environment. An embodiment of a method of protecting a component and/or connecting components in a wet environment includes deploying a granulated disintegrable material into the wet environment before and/or during a wet connection process. The granulated disintegrable material is accumulated (and may be compacted) on at least a portion of a wet connection assembly (e.g., a lower wet connector) and is configured to prevent debris and other unwanted material from affecting the portion of the wet connection assembly. A triggering mechanism is applied to disintegrate the granulated disintegrable material. The triggering mechanism may be downhole fluid, a disintegrating fluid injected into the wet environment (e.g., an acid, solvent or other material), an electric current or any other suitable trigger. Downhole fluid and/or disintegrating fluid can be used to flush or otherwise move the disintegrated material away from the wet connection assembly in preparation for making a connection, e.g., connecting the lower wet connector to an upper wet connector.

Figure 1:
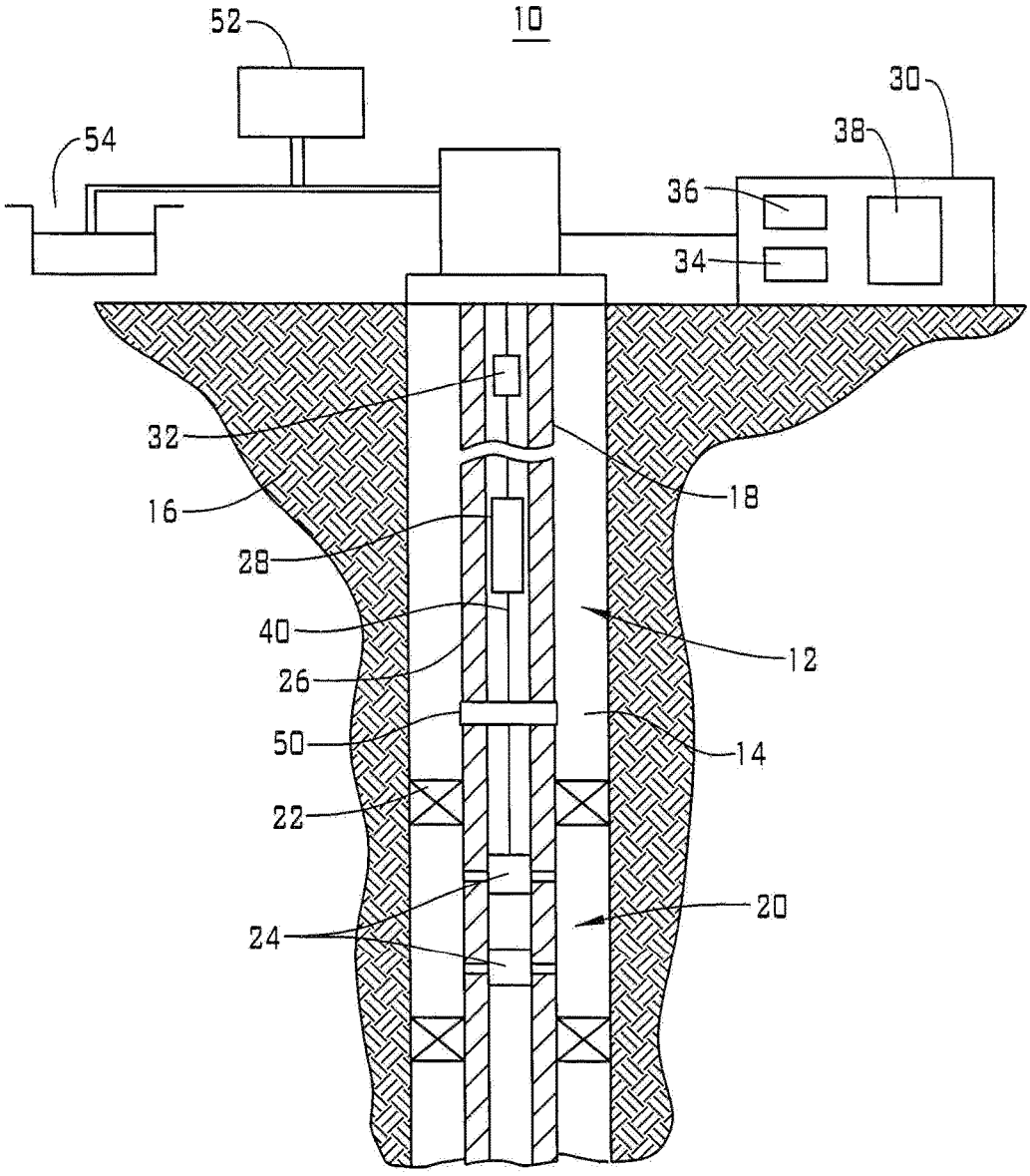
FIG. 1 depicts an embodiment of a hydrocarbon production system.

FIG. 1 illustrates an embodiment of a system 10 that can be used to perform one or more energy industry operations. The system 10 may be used to perform various energy industry operations, such as drilling, measurement, stimulation and/or production operations. The system 10 includes a borehole string 12 disposed in a borehole 14 that penetrates at least one earth formation 16. At least a portion of the borehole 14 may include a casing. In one example, the system 10 is configured as a production system in which the borehole string 12 includes production tubing 18 deployed in the borehole 14.

The borehole string 12 may include a production assembly 20 that is configured to establish one or more production zones. The production assembly 20 may include one or more packers 22 or other isolation devices to isolate zones along the borehole. Flow control devices 24 (e.g., ICD, valve, screen, etc.) may be installed adjacent openings or perforations in the production tubing 18 to control the flow of formation fluid and/or borehole fluid into the production tubing 18 and to prevent or inhibit solids, such as sand, from entering into the borehole 14 from production zones.

Various other components may be deployed downhole, either with the production assembly 20 or separately. Examples of such components include additional production assemblies, tubing sections, measurement devices, tools and/or any other device or system for facilitating or controlling aspects of an energy industry operation. Other examples of downhole components include an artificial lift mechanism, such as an electrical submersible pump (ESP), a gas lift system, a beam pump, a jet pump, a hydraulic pump or a progressive cavity pump, to pump fluids to the surface.

Downhole components may include one or more measurement tools 26 deployed downhole for measuring parameters, properties or conditions of the borehole, formation and/or downhole components. The measurement tool 26 may incorporate one or more sensing devices 28. Examples of sensing devices include temperature sensors, pressure sensors, flow measurement sensors, resistivity sensors, porosity sensors (e.g., nuclear sensors or acoustic sensors), fluid property sensors and others.

Downhole components such as the production assembly 20 and the tool 26 may be in communication with each other, and/or with a processing device. For example, downhole components communicate with a processing device such as a surface processing unit 30 and/or downhole electronics 32. The processing device includes components for performing functions including communication, data storage, data processing and/or control of components. For example, the surface processing unit 30 includes an input/output unit 34, a processor 36 (e.g., a microprocessor) and memory 38 to store data, models and/or computer programs or software. The processing device may be configured to perform functions such as controlling deployment of downhole components, controlling operation of components, transmitting and receiving data, processing measurement data and/or monitoring operations.

Components of the system 10 may be connected to the processing unit 30, the downhole electronics 32 and/or any other suitable processor via any suitable communication regime, such as mud pulse telemetry, electro-magnetic telemetry, wired links (e.g., hard wired drill pipe or coiled tubing), wireless links, optical links or others. For example, a conductor 40 connects components such as the production assembly 20 and/or the tool 26 to the surface processing unit 30. The conductor 40 includes, e.g., one or more electrical conductors and/or one or more optical fibers deployed as a cable or control line.

In one embodiment, the system 10, or one or more components thereof, includes a wet connection assembly 50. The wet connection assembly is configured to affect an operable connection (e.g., mechanical, electrical and/or optical connection) between downhole components and/or between downhole components and the surface. The wet connection assemblies generally enables components to be connected while downhole and in a wet environment, e.g., an environment that includes one or more fluids, such as water, hydrocarbons, drilling fluid (mud), production fluid, stimulation fluid, etc.

The system 10 includes a connection system that includes the wet connection assembly 50 and a mechanism for deploying a disintegrable granulated material into a wet environment to protect components of the wet connection assembly 50 and/or other downhole components before and during engagement of wet connection assembly components. The granulated material may be pumped or otherwise advanced into the borehole from, e.g., a container 52 at the surface. The material can be pumped, e.g., with drilling mud, production fluid or other suitable fluid from a fluid source or tank 54.

The connection system is configure to pump or otherwise deploy the granulated material to a connector or other component. The granulated material is allowed to accumulate on the connector to protect the connector from falling debris, sand or other unwanted material. The granulated material can then be disintegrated by fluid in the wet environment and/or a fluid configured to disintegrate (e.g., at least partially dissolve or further break up into smaller pieces. The disintegrated material can then be removed, e.g., by flushing the disintegrated material away from the connector to allow the connector to be engaged with another connector or component.

As described herein, a "granulated material" refers to a material that is in a granular form, i.e., made up of particles, grains or other size pieces that can be injected into a circulated fluid or flowed through a wet environment. The size of the grains or particles can be any desired size. For example, the desired size can be selected based on the type of unwanted material from which the wet connection assembly is to be protected while connectors of the connection assembly are engaged. For example, if the unwanted material includes sand, the grains of the disintegrable material are selected to be about the same as or smaller than the sand grains.

Also as described herein, "disintegrating" refers to causing at least some of the granulated material to be broken up into smaller parts. For example, disintegrating the granulated material can include breaking up the granulated material into smaller parts so that the material can be flushed away, and/or at least partially dissolving the granulating material in a fluid.

FIGS. 2-10 show an example of a connection system, which includes a first wet connector 60 configured to engage a second wet connector 62 (FIG. 4) to operably connect downhole components. The first wet connector 60 in this example is a male connector and the second wet connector 62 is a female connector. Typically the female connector is positioned uphole of the male connector within a borehole, because the male connector is less likely to suffer from a collection of debris therein, however the connectors can be employed in a reversed orientation. Each connector includes a bore or conduit through which fluid can flow.

In this example, the first wet connector 60 is a lower connector and the second wet connector 62 is an upper connector. A lower connector refers to a connector that is further away from a surface of the borehole 14, and an upper connector refers to a connector that is closer to the surface. It is noted that the terms lower and upper are not meant to denote a particular configuration. For example, if the borehole is a deviated or horizontal borehole, the lower and upper connectors may have the same or similar vertical depths. In some cases, depending on the path of the borehole, the lower connector may have a smaller vertical depth than the upper connector.

The granulated disintegrable material may be made from any suitable disintegrable material, which can be configured to corrode or degrade at a known rate in the presence of downhole fluid and/or can be configured to disintegrate in response to a trigger. Examples of a trigger include downhole fluid, a disintegrating fluid such as an acid or a solvent, an electric current, the application of heat or other suitable triggering mechanism.

The disintegrable material may include a polymeric material, a metallic material, or a combination thereof. The polymeric material and the metallic material can corrode once exposed to a disintegrating fluid, such as water, brine, acid, or a combination thereof. Examples of disintegrating fluids include potassium chloride (KCl), hydrochloric acid (HCl), calcium chloride ($CaCl_2$), calcium bromide ($CaBr_2$) and zinc bromide ($ZnBr_2$).

Examples of polymeric materials include a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

The disintegrable material can be a corrodible metallic material, which includes a metal, a metal composite, or a combination thereof. As used herein, a metal includes metal alloys.

Examples of corrodible metallic materials include zinc metal, magnesium metal, aluminum metal, manganese metal, an alloy thereof, or a combination comprising at least one of the foregoing. In addition to zinc, magnesium, aluminum, manganese, or alloys thereof, the corrodible material can further comprise a cathodic agent such as Ni, W, Mo, Cu, Fe, Cr, Co, an alloy thereof, or a combination comprising at least one of the foregoing to adjust the corrosion rate of the corrodible material.

In one embodiment, the disintegrable material is made from a magnesium alloy. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination including at least one of these alloys. Alloying or trace elements can be included in varying amounts to adjust the corrosion rate of the magnesium.

The corrodible metallic material can be formed from coated particles such as powders of Zn, Mg, Al, Mn, an alloy thereof, or a combination comprising at least one of the foregoing. The powder can be coated with a metal or metal oxide such as Al, Ni, W, Co, Cu, Fe, oxides of one of these metals, or the like. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM).

The connection system may be used to perform a method of connecting components in a wet environment and/or protecting a component during a connection process. The method includes one or more stages, which may be executed in the order described. However, certain stages may be omitted, stages may be added, or the order of the stages changed.

FIGS. 2-10 illustrate aspects of the method in conjunction with a wet connection system of a borehole. The connection system is discussed for illustrative purposes but is not intended to be limiting, as the method may be performed in conjunction with any suitable device, system or component that is disposed in a wet environment.

Figure 2:
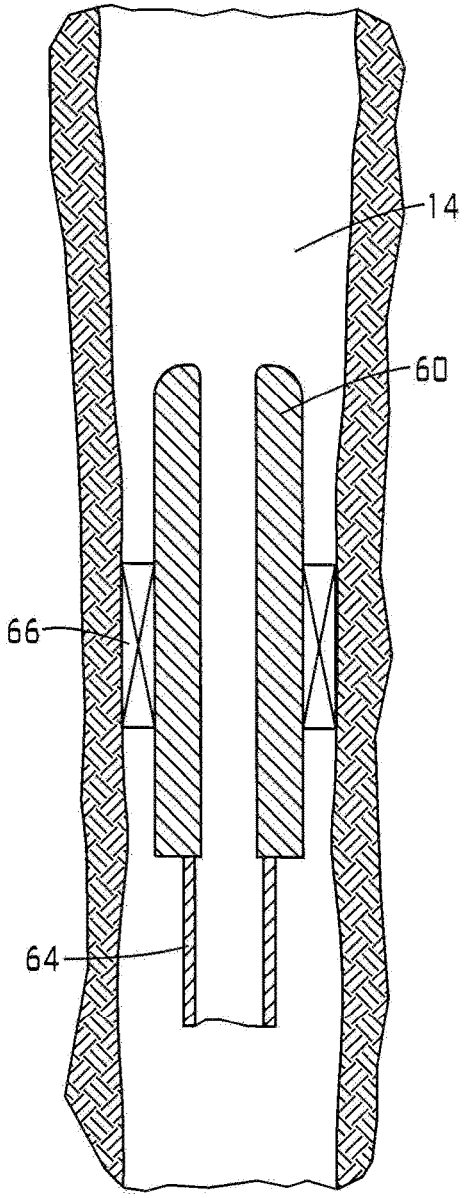
FIG. 2 depicts a first connector of an embodiment of a wet connection assembly.

In a first stage, a connector such as the first connector 60 is deployed in a cased or open borehole (e.g., the borehole 14). The first connector 60 is attached to a component such as a lower completion and/or a production assembly. At least part of the borehole is filled with downhole fluid, which may include fluid injected into the borehole (e.g., water, brine, stimulation fluid, hydraulic fracturing fluid, etc.) and/or formation fluid such as water and hydrocarbons. As shown in FIG. 2, the first connector 60 is a male connector that is attached to a tubular 64 (e.g., the production tubing 18). A packer 66 isolates a portion of the borehole and may be used to establish a production zone.

Figure 3:
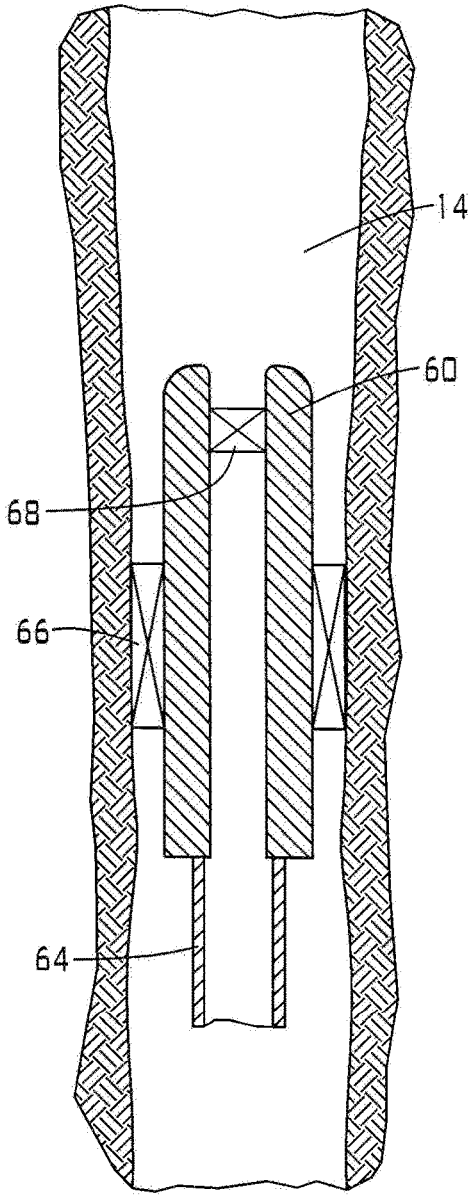
FIG. 3 depicts the wet connection assembly of FIG. 2 including a bridge plug.

In a second stage, as shown in FIG. 3, a temporary bridge plug 68 may be inserted into the first connector 60 and/or the tubular 64. The bridge plug 68 may be made of a disintegrable material, which may be the same material as the granulated material discussed herein, or may be a different material. The bridge plug 68 can be deployed with the connector 60 and/or the tubular 64, or deployed after the connector 60 and/or the tubular 64 is disposed downhole and latched to the packer 66, the tubular 64 or the first connector 60. It should be understood that, in lieu of bridge plug 68, a fluid loss device may be arranged downhole relative to first connector 60. The fluid loss device could take on a variety of forms including, but not limited to, ball valves and fluid loss flapper valves.

Figure 4:
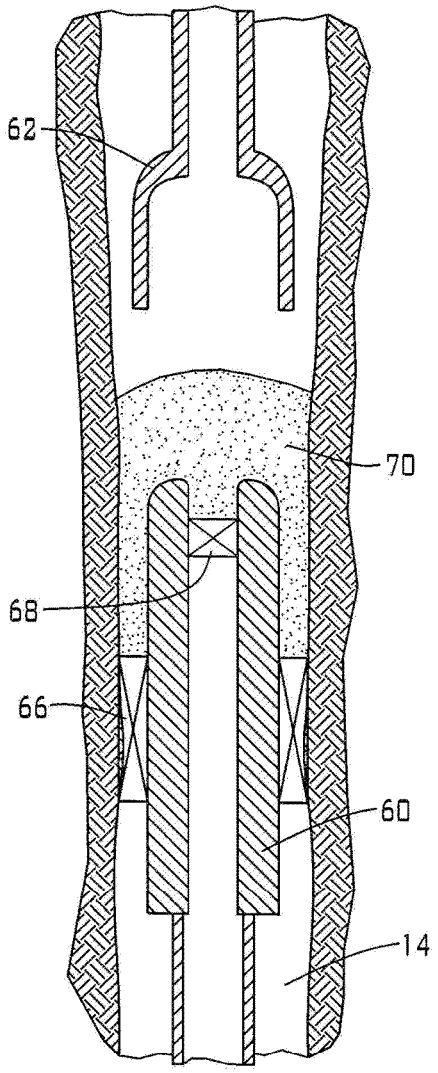
FIG. 4 depicts a temporary cover for the first connector of FIG. 2, the temporary cover made from a granulated disintegrable material.
Figure 5:
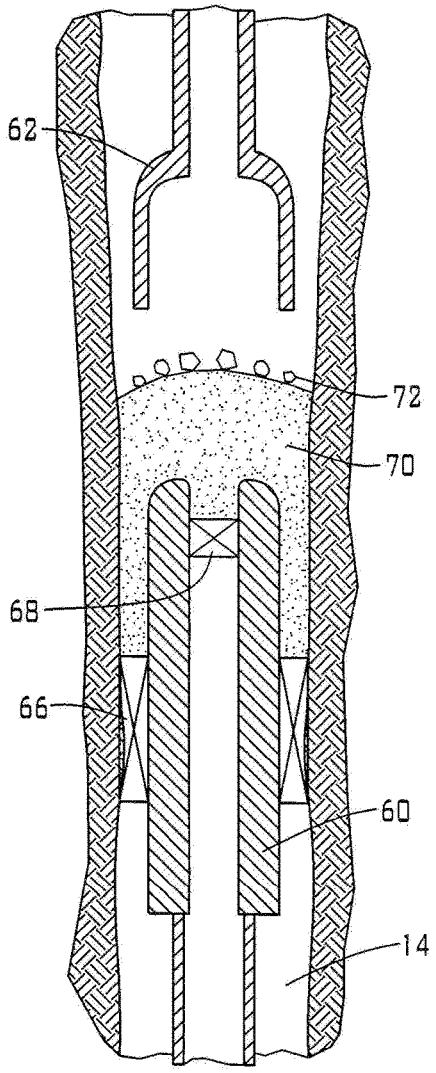
FIG. 5 depicts functionality of the temporary cover of FIG. 4 in preventing debris from impacting the lower connector.

In a third stage, as shown in FIG. 4, a second connector 62, which may be attached to an upper completion (not separately labeled) may be run into the borehole and a granulated disintegrable material 70 is pumped or otherwise advanced downhole onto exposed portions of the first connector 60. For example, granulated CEM is injected into the borehole and allowed to settle and/or compact as a pile on surfaces of the first connector 60. Debris 72 that falls out will not settle around the lower connector, but rather on top of the covering pile of the disintegrable material 70, as shown in FIG. 5. It should be appreciated that disintegrable material 70 may be deposited on first connector 60 prior to introducing an upper completion that may carry second connector 62. The upper completion may be later introduced and employed to displace/remove disintegrable material 70 as will be discussed herein.

Figure 6:
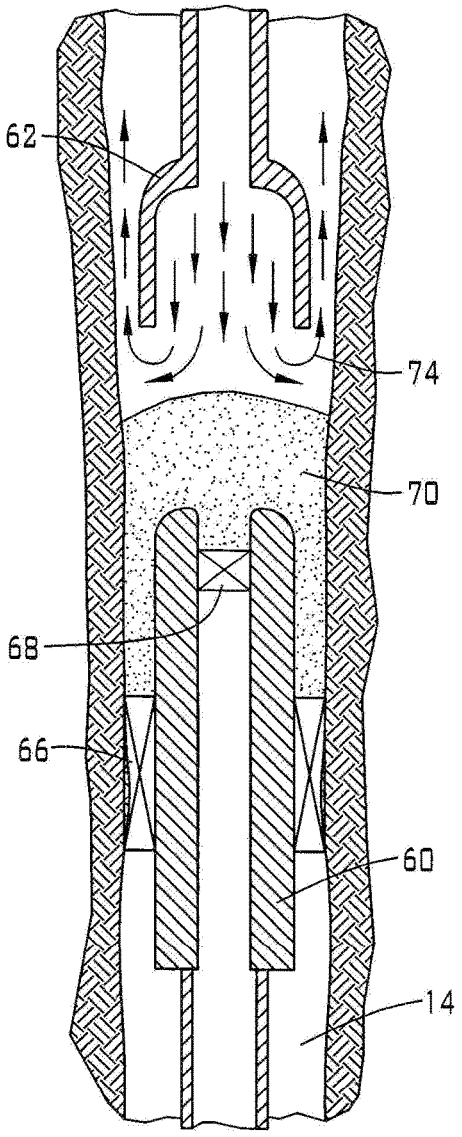
FIG. 6 depicts the circulation of fluid to remove debris prior to removing the temporary cover of FIG. 4.
Figure 7:
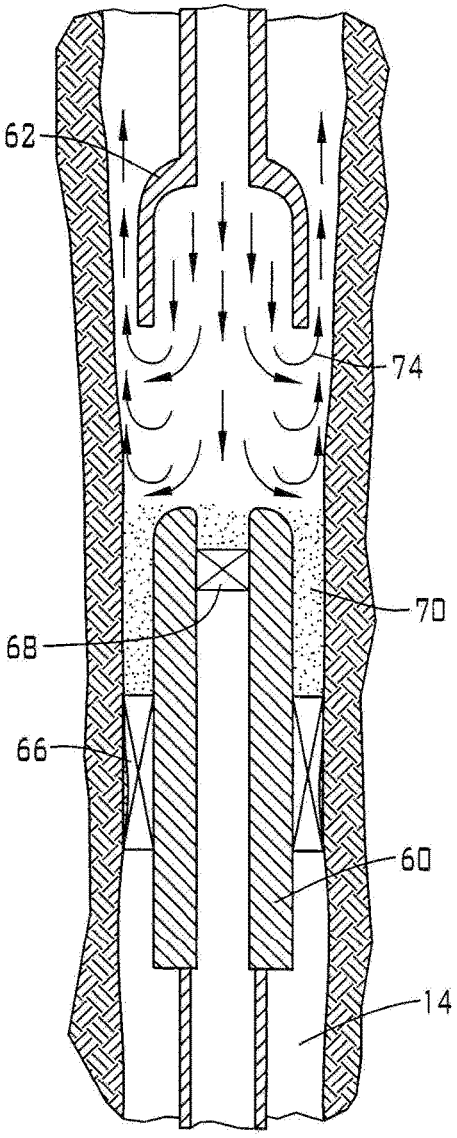
FIG. 7 depicts the circulation of disintegrating fluid to remove the temporary cover of FIG. 4.
Figure 8:
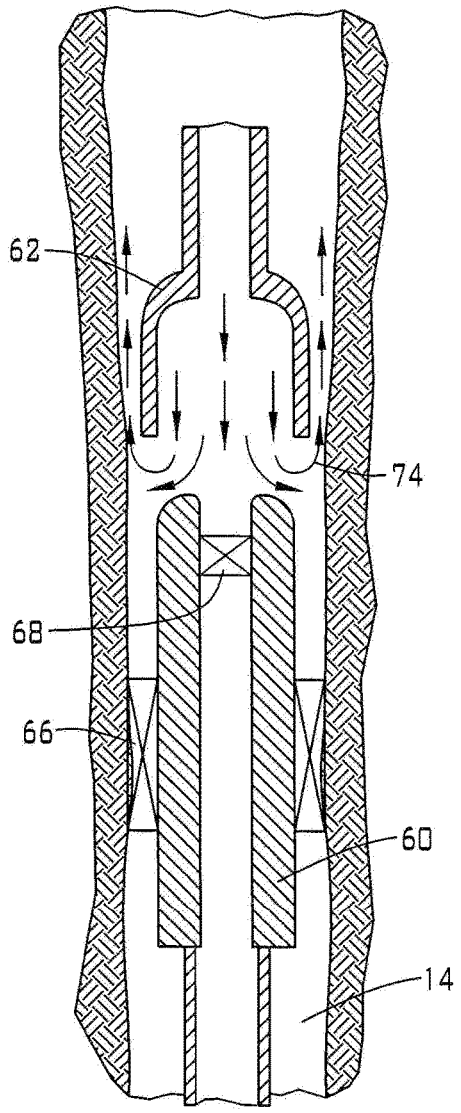
FIG. 8 depicts the positioning of a second connector of the wet connection assembly during circulation of disintegrating fluid to remove the temporary cover of FIG. 4.

In a fourth stage, as shown in FIG. 6, downhole fluid 74 can be circulated to remove the debris 72. Acid or another disintegrating fluid 76 is circulated to disintegrate the CEM material and remove the disintegrated material. For example, as the connectors are mated, the presence of the acid will disintegrate (e.g., corrode and/or at least partially dissolve) the disintegrable material 70. As shown in FIGS. 7 and 8, the disintegrating fluid 76 can be continuously circulated as the first and second connectors are mated.

In one embodiment, in addition to or in place of the disintegrating fluid 76, the disintegrable material 70 is disintegrated by applying downhole fluid or another trigger. For example, downhole fluid 74 may be circulated onto the disintegrating material for a selected amount of time based on the disintegration or corrosion rate of the disintegrable material 70, and flushed away from the connectors by the downhole fluid 74.

Figure 9:
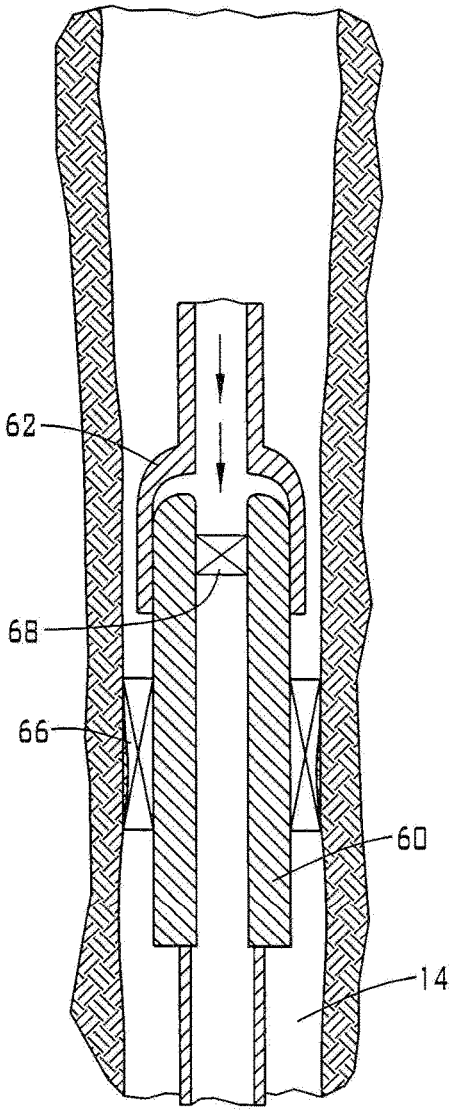
FIG. 9 depicts engagement of the wet connection assembly after removal of the temporary cover of FIG. 4.
Figure 10:
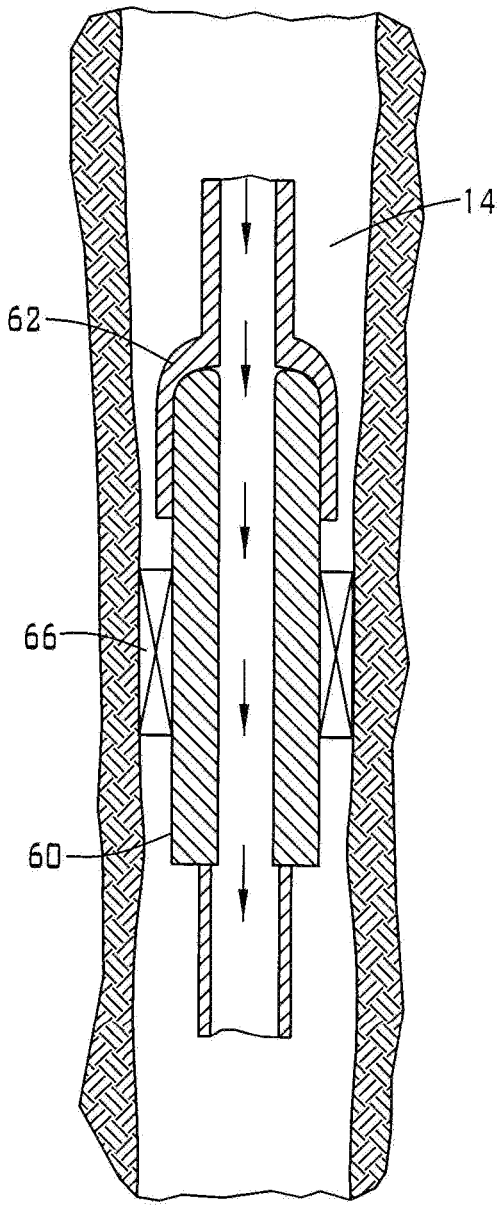
FIG. 10 depicts an assembled wet connection assembly.

In a fifth stage, the connectors are engaged and fluid flow through the borehole string is established. Appropriate connections (e.g., electric, hydraulic and/or fiber optic connections) are made. As shown in FIG. 9, the bridge plug is removed, e.g., by continuing to circulate the disintegrating fluid 76, by circulating a different disintegrating fluid or by another mechanism. The completed connection is shown in FIG. 10.

The debris 72 and/or the material 70 can be circulated to the surface or moved away from the connection assembly after disintegration without circulating the debris and/or material all the way to the surface. For example, debris and/or the material need only be circulated above the second connector 62 so that the connection can be made.

Although embodiments are described herein in conjunction with a production system including production tubing, the embodiments may be applied to any suitable energy industry system or component, such as a drill pipe, pipe segments, a drilling assembly (including, e.g., a drill bit and mud motor), coiled tubing, wired pipe, wireline tools, logging-while-drilling (LWD) tools and measurement-while-drilling (MWD) tools.

Embodiments described herein provide a number of advantages and technical effects. The connection system and method provide for an effective technique for protecting connectors in a wet environment. The embodiments can be used for any situation where a wet connection is made and there is potential for unwanted material to interfere with effective connections.

For example, there are instances where normal circulation is not able to get debris out of the way when latching downhole wet connect tools. Embodiments allow for the use of very low circulation rates to move debris up and out of the way to allow attachment of the wet connect, even in such instances. As the granulated material is made from a disintegrable material, connections can be made and protected without requiring that debris be completely circulated out of a borehole.

Embodiment 1

A method of protecting a component in a wet environment, comprising disposing a component into a wet environment, deploying a granulated disintegrable material into the wet environment and temporarily covering a portion of the component with the granulated disintegrable material, at least partially disintegrating the granulated disintegrable material, and flushing the granulated disintegrable material away from the portion.

Embodiment 2

The method of any prior embodiment, wherein at least partially disintegrating includes exposing the granulated disintegrable material to a fluid that makes up at least part of the wet environment.

Embodiment 3

The method of any prior embodiment, wherein at least partially disintegrating the granulated disintegrable material includes injecting a disintegrating fluid into the wet environment and exposing the granulated disintegrable material to the disintegrating fluid.

Embodiment 4

The method of any prior embodiment, wherein the wet environment includes a first fluid, and the disintegrating fluid is a second fluid that is different than the first fluid.

Embodiment 5

The method of any prior embodiment, wherein the component includes a wet connection device having a first wet connector configured to engage a second wet connector of another component.

Embodiment 6

The method of any prior embodiment, wherein the granulated disintegrable material is configured to cover at least part of the first wet connector and be flushed away from the first wet connector prior to engaging the first wet connector with the second wet connector.

Embodiment 7

The method of any prior embodiment, further comprising disposing a plug at the first wet connector prior to covering the portion of the component with the granulated disintegrable material.

Embodiment 8

The method of any prior embodiment, wherein the plug is made from a disintegrable material, the method further comprising removing the plug after engaging the first wet connector with the second wet connector.

Embodiment 9

The method of any prior embodiment, wherein removing the plug includes exposing the plug to a disintegrating fluid.

Embodiment 10

The method of any prior embodiment, wherein the granulated disintegrable material is made from a controlled electrolytic material (CEM).

Embodiment 11

A system for protecting a component in a wet environment, comprising a deployment device configured to deploy a granulated disintegrable material into the wet environment and temporarily cover a portion of a component in the wet environment with the granulated disintegrable material, a triggering device configured to at least partially disintegrate the granulated disintegrable material, and a fluid control device configured to flush the granulated disintegrable material away from the portion.

Embodiment 12

The system of any prior embodiment, wherein the granulated disintegrable material is at least partially disintegrated by exposing the granulated disintegrable material to a fluid that makes up at least part of the wet environment.

Embodiment 13

The system of any prior embodiment, wherein the granulated disintegrable material is at least partially disintegrated by injecting a disintegrating fluid into the wet environment and exposing the granulated disintegrable material to the disintegrating fluid.

Embodiment 14

The system of any prior embodiment, wherein the wet environment includes a first fluid, and the disintegrating fluid is a second fluid that is different than the first fluid.

Embodiment 15

The system of any prior embodiment, wherein the component includes a wet connection device having a first wet connector configured to engage a second wet connector of another component.

Embodiment 16

The system of any prior embodiment, wherein the granulated disintegrable material is configured to cover at least part of the first wet connector and be flushed away from the first wet connector prior to engaging the first wet connector with the second wet connector.

Embodiment 17

The system of any prior embodiment, wherein the deployment device is configured to dispose a plug at the first wet connector prior to covering the portion of the component with the granulated disintegrable material.

Embodiment 18

The system of any prior embodiment, wherein the plug is made from a disintegrable material and is configured to be removed after engaging the first wet connector with the second wet connector.

Embodiment 19

The system of any prior embodiment, wherein the plug is configured to be removed by exposing the plug to a disintegrating fluid.

Embodiment 20

The system of any prior embodiment, wherein the granulated disintegrable material is made from a controlled electrolytic material (CEM).

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of protecting a component in a downhole environment, comprising:

disposing the component into the downhole environment, wherein the component includes a wet connection device having a first wet connector configured to engage a second wet connector of another component;

deploying a granulated disintegrable material into the downhole environment separately from the component and temporarily covering a portion of the component with the granulated disintegrable material;

at least partially disintegrating the granulated disintegrable material; and flushing the granulated disintegrable material away from the portion.

2. The method of claim 1, wherein at least partially disintegrating includes exposing the granulated disintegrable material to a fluid that makes up at least part of the downhole environment.

3. The method of claim 1, wherein at least partially disintegrating the granulated disintegrable material includes injecting a disintegrating fluid into the downhole environment and exposing the granulated disintegrable material to the disintegrating fluid.

4. The system of claim 3, wherein the downhole environment includes a first fluid, and the disintegrating fluid is a second fluid that is different than the first fluid.

5. The method of claim 1, wherein the granulated disintegrable material is configured to cover at least part of the first wet connector and be flushed away from the first wet connector prior to engaging the first wet connector with the second wet connector.

6. The method of claim 1, further comprising disposing a plug at the first wet connector prior to covering the portion of the component with the granulated disintegrable material.

7. The method of claim 6, wherein the plug is made from a disintegrable material, the method further comprising removing the plug after engaging the first wet connector with the second wet connector.

8. The method of claim 7, wherein removing the plug includes exposing the plug to a disintegrating fluid.

9. The method of claim 1, wherein the granulated disintegrable material is made from a controlled electrolytic material (CEM).

10. The method of claim 1, wherein deploying the granulated disintegrable material includes accumulating the granulated disintegrable material on the component.

11. A system for protecting a component in a downhole environment, comprising:

the component, wherein the component includes a wet connection device having a first wet connector configured to engage a second wet connector of another component;

a deployment device configured to deploy a granulated disintegrable material into the downhole environment after deploying the component and temporarily cover a portion of the component in the downhole environment with the granulated disintegrable material;

a triggering device configured to at least partially disintegrate the granulated disintegrable material; and a fluid control device configured to flush the granulated disintegrable material away from the portion.

12. The system of claim 11, wherein the granulated disintegrable material is at least partially disintegrated by exposing the granulated disintegrable material to a fluid that makes up at least part of the downhole environment.

13. The system of claim 11, wherein the granulated disintegrable material is at least partially disintegrated by injecting a disintegrating fluid into the downhole environment and exposing the granulated disintegrable material to the disintegrating fluid.

14. The system of claim 13, wherein the downhole environment includes a first fluid, and the disintegrating fluid is a second fluid that is different than the first fluid.

15. The system of claim 11, wherein the granulated disintegrable material is configured to cover at least part of the first wet connector and be flushed away from the first wet connector prior to engaging the first wet connector with the second wet connector.

16. The system of claim 11, wherein the deployment device is configured to dispose a plug at the first wet connector prior to covering the portion of the component with the granulated disintegrable material.

17. The system of claim 16, wherein the plug is made from a disintegrable material and is configured to be removed after engaging the first wet connector with the second wet connector.

18. The system of claim 17, wherein the plug is configured to be removed by exposing the plug to a disintegrating fluid.

19. The system of claim 11, wherein the granulated disintegrable material is made from a controlled electrolytic material (CEM).

20. The system of claim 11, wherein the deployment device is configured to deploy the granulated disintegrable material so as to accumulate on the component.

* * * * *